United States Patent [19]

Wilbanks

[11] 4,312,160

[45] Jan. 26, 1982

[54] BUILDING STRUCTURE HAVING AN IMPROVED TRUSS ASSEMBLY

[75] Inventor: John V. Wilbanks, Theodore, Ala.

[73] Assignee: June Landers Wilbanks, Theodore, Ala.

[21] Appl. No.: 110,947

[22] Filed: Jan. 10, 1980

[51] Int. Cl.[3] ..... E04B 7/08; E04C 3/42

[52] U.S. Cl. ..... 52/92; 52/639; 52/643

[58] Field of Search ..... 52/639, 643, 90, 92

[56] References Cited

U.S. PATENT DOCUMENTS

| | | | |
|---|---|---|---|
| 1,230,305 | 6/1917 | Klay | 52/639 X |
| 1,926,159 | 9/1933 | McKee | 52/639 X |
| 2,332,059 | 10/1943 | Cheshier | 52/643 |

FOREIGN PATENT DOCUMENTS

| | | | |
|---|---|---|---|
| 625500 | 4/1927 | France | 52/639 |
| 642231 | 5/1928 | France | 52/90 |
| 248954 | 6/1926 | Italy | 52/639 |

OTHER PUBLICATIONS

American Builder, Jul. 1954, pp. 51–54.

*Primary Examiner*—Alfred C. Perham

*Attorney, Agent, or Firm*—Newton, Hopkins & Ormsby

[57] ABSTRACT

A pair of opposed parallel upright walls formed of upstanding studs support a pair of longitudinally standing parallel, horizontal opposed double plates, respectively. These double plates respectively support the outer end portions of a pair of converging upwardly and inwardly extending roof rafters, the ends of which abutt each other at the central portion of the building. A pair of truss struts criss-cross beneath the peak of the roof rafters, the outer ends of the truss struts resting on the plates and the inner ends of the truss struts being secured to intermediate portions of the opposite roof rafters. Bolts secure the end portions of the truss struts in place. A king post extends vertically upwardly from the junction or intersection of the truss struts and is connected to the junction of the roof rafters. Queen posts disposed on opposite sides and parallel to the king posts extend from the end portions of the truss struts downwardly to intersect approximately the mid portion of the opposite truss struts. A plurality of the truss assemblies are disposed in spaced adjacent parallel relationship and parallel longitudinally extending runners recessed into the truss struts join adjacent truss struts together.

6 Claims, 2 Drawing Figures

BUILDING STRUCTURE HAVING AN IMPROVED TRUSS ASSEMBLY

BACKGROUND OF THE INVENTION

1. Field of the Invention

This invention relates to a truss assembly and is more particularly concerned with a building structure which has improved truss assemblies for supporting the roof thereof.

2. Description of the Prior Art

In the past, truss assemblies have been developed which support the roof of buildings. Such truss assemblies are normally disposed in spaced, parallel relationship along a building in order to support the roof of the building. Such conventional truss assemblies usually include a pair of upwardly converging roof rafters joined at their upper ends, a truss strut which extends across from one end portion of one roof rafter to the other and reinforcing struts. Thus, essentially these prior art truss assemblies are triangular in shape.

U.S. Pat. No. 2,886,857 to K. H. Brosenius for WOODEN BEAM CONSTRUCTION shows a truss assembly formed of a pair of webs which include flanges on one web which diverge from each other, the lower flanges appearing to criss-cross the lower flange of an adjacent web. The webs are built up from a plurality of juxtaposed wooden members which are nailed together. The structure depicted in this patent is not particularly strong and probably readily shift in high winds.

U.S. Pat. No. 3,969,869 issued to Arthur F. Partridge for BUILDING TRUSS discloses a quite complex truss formed of a pair of triangular members which the upper ends of which are overlapped and joined together.

U.S. Pat. No. 4,005,556 issued to Roger L. Tuomi for LIGHTWEIGHT TRUSS-FRAMED HOUSE discloses a truss with reinforcing intermediate webbed members which join the top and bottom roof cords.

U.S. Pat. No. 3,747,290 discloses still another form of truss in which there are various reinforcing elements between the rafters and the joist.

The applicant's truss assembly is simpler to manufacture, is more durable in structure and will withstand extreme wind forces.

SUMMARY OF THE INVENTION

Briefly described, the present invention includes a building, such as a boat house which has a pair of opposed, parallel walls formed by upstanding studs which carry a pair of parallel, longitudinally extending horizontally disposed top struts or plates which carry the end portions of a plurality of equally spaced truss assemblies.

Each truss assembly includes a pair of upwardly converging, transversely aligned, roof rafters, the upper ends of each pair of rafters being joined together and the lower ends being carried by the top plates. Below the roof rafters, respectively, are the truss struts which criss-cross vertically below the peak of the roof so that the end portions of these truss struts join intermediate portions of the roof rafters. An upstanding king post extends from the junction of the truss struts upwardly to the junction of the roof rafters while a pair of queen posts are arranged, spaced on opposite sides and parallel to the king post, these queen posts extending vertically from intermediate portions of the truss struts upwardly to the junction of the roof rafter and the truss strut.

Accordingly, it is an object of the present invention to provide a truss assembly which is inexpensive to manufacture, durable in structure and efficient in operation.

Another object of the present invention is to provide a truss assembly which will withstand extremely high winds.

Another object of the present invention is to provide a truss assembly which is particularly suitable for use in connection with boat houses.

Another object of the present invention is to provide a truss assembly which will provide a maximum amount of overhead clearance, while at the same time providing a strong supporting structure for a roof.

Another object of the present invention is to provide a building structure with improved truss assemblies wherein the roof thereof supported by truss assemblies which will permit maximum headroom within the building while, at the same time, providing strong support for the roof and which does not place appreciable stresses on the fastening members which join the respective elements together.

Another object of the present invention is to provide a building structure which has a plurality of truss assemblies wherein the truss assemblies do not exert any appreciable outward force on the sidewalls of the building assembly.

Other objects, features and advantages of the present invention will become apparent from the following description taken in conjunction with the accompanying drawings wherein in like characters of reference designate corresponding parts throughout the several views.

DESCRIPTION OF THE PREFERRED EMBODIMENT

Figure 1:
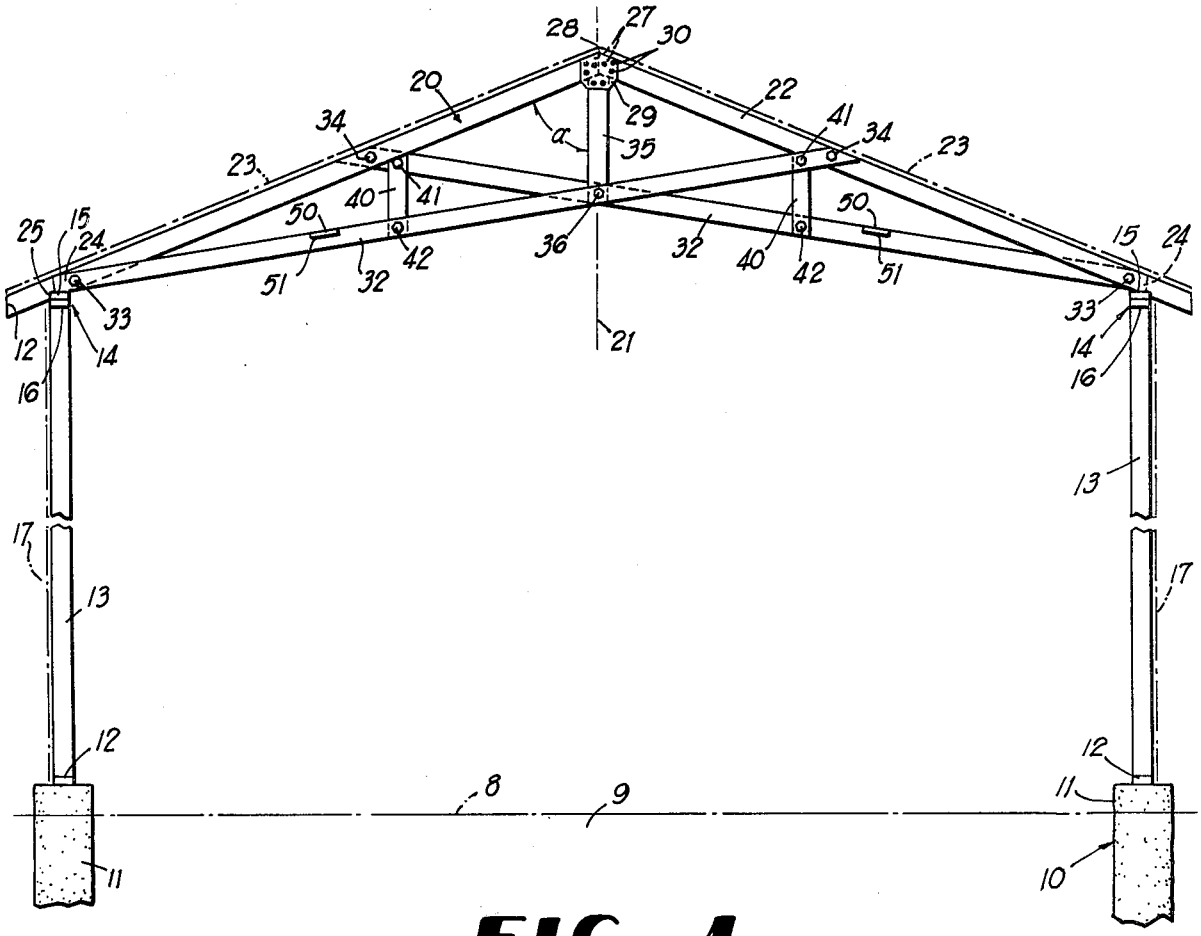
FIG. 1 is a cross sectional view of a portion of a boat house having the truss assemblies of the present invention supporting the roof thereof.
Figure 2:
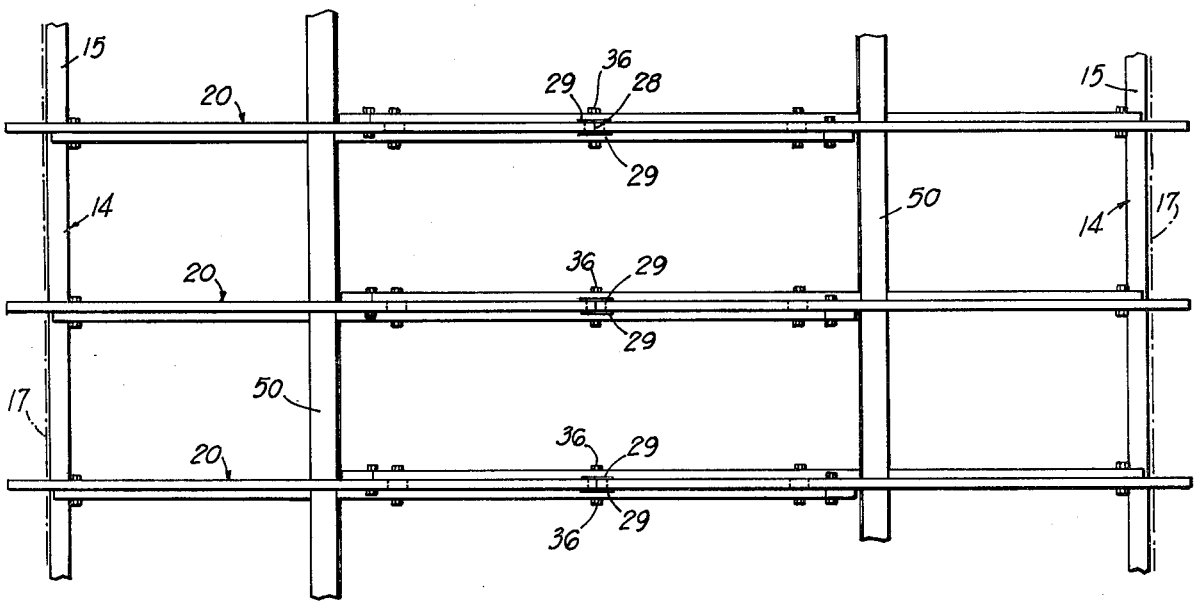
FIG. 2 is a fragmentary top plane view of a portion of a boat house depicted in FIG. 1.

Referring now in detail to the embodiment chosen for the purpose of illustrating the present invention, numeral 10 denotes a footing or foundation which, in the present embodiment, includes a plurality of longitudinally spaced, parallel upstanding pilings 11 which are securely anchored at the bottom of a body of water 9 and extend above the upper surface 8 of water 9. The pilings 11 have their upper end portions disposed in a common horizontal plane, the pilings 11 being arranged in transversely spaced, longitudinal parallel rows, so as to support a pair of spaced, parallel horizontally extending base plates or beams 12.

Upstanding studs 13 are mounted in longitudinally spaced relationship along the upper surface of each of the base plates 12, the studs 13 being arranged in transversely opposed relationship parallel to each other as shown in FIG. 1. The upper ends of the studs 13 support a pair of double plates or struts 14 which are formed of an upper beam or strut 15 and a lower beam or strut 16. The lower beam 16 extends along and is received on and is secured to the upper ends of the studs 13 in one longitudinal row while the other lower beam 16 is secured to and received by the upper ends of the other longitudinal row of studs 13. The upper beams 15 are mounted flat onto the upper surfaces respectively of the lower beams 16 and are secured thereto by conventional means. The studs 13 and beams 12, 15 and 16 are straight rigid, integrally, rectangular, wooden members.

Outwardly of the studs 13 are the vertical opposed parallel sidewalls 17, shown in broken lines in FIG. 1.

According to the present invention, the roof assembly includes a plurality of spaced, parallel, transversely extending, truss assemblies, denoted generally by the numeral 20. These truss assemblies are identical to each other and, therefore, a detailed description of a single truss assembly will suffice. Each truss assembly 20 is formed of straight rigid rectangular wooden members having a vertical center line 21 and includes a pair of opposed, transversely aligned, inwardly and upwardly inclined, converging or upwardly tapered, rigid, straight rectangular, wooden roof rafters 22, the function of which is to support the roof panels which are shown in broken lines and denoted by the numerals 23.

The lower outer end portions of each roof rafter 22 protrudes outwardly of the sidewall and has its lower portion provided with a right angular notch 19 which provides a straight, horizontally disposed, recessed, bearing surface 24, the outer end of which intersects a vertically disposed outer shoulder 25. The bearing surface 24 of each roof rafter 22 rides flat upon the upper surface of its associated upper beam 15 while the shoulder 26 thereof is disposed outwardly adjacent to the outer side portion of the upper beam 15.

The upper or inner ends of the transversely aligned roof rafters 22 are levelled or cut at angles so that the upper or inner end 27 of each roof rafter 22 is vertically disposed to abutt the vertically disposed end 27 of the opposite roof rafter 22.

It will be understood that the roof rafters 22, being rectangular wooden members, are joined together to form a peak 28 by means of a nailing plate 29 disposed flat against the side end portions of the rafters 22 by means of fastening means, such as nails 30. The pitch of the roof is from about four inches for each foot of roof to about seven inches for each foot of roof.

Generally below but spaced apart by the roof rafters 22 are a pair of criss-crossed truss struts 32 which are secured at their outer end portions by means of fastening means, such as longitudinally extending bolts 33 to the end portions of the roof rafters 22, respectively, slightly inwardly of the double plates 14. Thus, the end portion of the truss struts 32 which are outwardly of bolts 33 rest upon the upper surfaces of the beams 15 of the double plates 14.

The truss struts 32 extend inwardly and upwardly, diverging from their respective roof rafters 22 so as to pass each other vertically below the peak 28 approximately one-half the way between the plane of the upper surfaces of the beams 15 and the lower end portions of the roof rafters 22. The truss struts 22 are straight and continue upwardly and outwardly beyond the center line 21 to terminate adjacent to an intermediate portion of the opposite roof rafter 22. One truss strut 32 is disposed forwardly of the transversely aligned roof rafters 22 so that the sides of its outer end portion abutts the side surface of each roof rafter 22 while the other truss strut 32 is disposed on the inner side of the two roof rafters 22. Therefore, at the intersection of the truss struts 32, there is a spacing of approximately the thickness of the roof rafters 22 between the adjacent inner surfaces of the criss-crossed portions of the truss struts 32.

Fastening means, such as bolts 34, secure the outer end portions of the truss struts 32 to the intermediate portions of the roof rafters 22 at positions approximately one-third the distance from peak 28 to the end of the rafter 22 while the ends of the truss struts 32 are beveled so as to be parallel to the outer surfaces respectively of their truss struts 22, as seen in FIG. 1.

Received between the spaced adjacent surfaces of the truss struts 32 is an upstanding king post 35 the lower end portion of which is between and secured to the criss-crossed portions of the truss struts 32 by a common fastening means, such as bolt 36. The king posts 35 extend upwardly and is generally pointed so as to receive and provide support for the lower inner end portions of the abutting roof rafters 22. The nail plate 29 extends over the upper end portion of the king post and nails 30 pass through this plate 29 and into the upper end portions of the king post 35 so as to secure the king post 35 in place, as seen in FIG. 1. The king post 35 is, thus, disposed vertically along the center line 21 and between the truss struts 32.

Disposed at equal distances on opposite sides of the center line 21 are a pair of queen posts 40 the upper end portion of which is beveled and abutts against the roof rafters 22, at a position such that a bolt 41 will pass through and join the upper end portion of queen post 40 to the upper end portion of the truss strut 32. The lower end portion of the queen post 40 is secured to an intermediate portion of its associated truss strut 32 by means of a fastening means, such as bolt 42.

The queen posts 40 are, therefore, rigid, rectangular, wooden upright members which are parallel to each other and are spaced approximately one-third the distance between the outer sides of the walls 17 and the center line 21, the queen posts 40 being parallel to and in a common transverse plane with the king posts 35. The king posts 35 and the queen posts 40 are thus in a common transverse plane with the roof rafters 22, one truss strut 32 being forwardly of that plane and the other truss strut 32 of the each truss assembly 20 being rearwardly thereof.

It will be understood that each of the fastening means or bolts 33, 34, 36, 41 and 42 are through bolts which are received in appropriate holes and protrude outwardly beyond the elements which they join so as to receive, threadedly thereon, nuts, in the usual way.

It will be seen that, when the portions of the struts 32 and rafters 22 are clamped by the bolts 33 or 34, such overlapped portions frictionally engage each other so as to reduce or eliminate the shearing load on such bolts. Hence, the abutting surfaces transfer the load from one element to the other without causing the entire load or even a major portion thereof to be transferred through the bolt.

It will now be seen that when a force is applied downwardly on the peak 28, for example, this force will be transmitted to the roof rafters 22, to the king posts 35 and, thence, to the truss struts 32. This force is distributed quite evenly so that the forces along the roof rafters 22 tend to tension the truss struts 32 while the compressive force in the king posts 35 will impart a bending force to these truss struts 32 which will be resisted by the tension therein. Furthermore, the loading of the roof 23 outwardly of the peak 28 will be resisted by the queen posts 40 and will also tend to impart a tension to the truss struts which will resist the bending which may be imparted by the queen posts 40 to the intermediate portions of the truss struts 32. Furthermore, such a loading will also be transmitted via the truss struts 32 and via the king posts 32 to the peak 28. Hence, the load on generally any portion of the roof 23 is distributed to all members and will never be totally carried by any one of the fastening means such as the bolts or the nails 30. Furthermore, there appears to be essentially no outward movement, transversely of the building, imparted to the side walls due to such a loading on the roof 23.

The roof rafters 22 which carry and transmit a major portion of the loading, are usually in compression which is immediately transmitted to all other elements of each truss when there is any loading on any part of the roof 23. The force on the double plates 14 is, however, essentially in a vertical direction.

The roof 23, itself, joins adjacent truss assemblies 20 together while spaced, longitudinal, parallel, runners 50, which are received within upwardly opening longitudinally aligned notches in the truss struts 32, resist longitudinal shifting of the truss assemblies 20. These notches 51 are outwardly adjacent to and spaced from the queen posts 40. It will be understood that it is preferable to form the various elements of the truss assembly, such as the roof rafters 22, the truss struts 32, the king posts 35 and the queen posts 40 of the same cross-sectional dimensions. Preferably they should be rectangular boards such as 2×6's or 2×8's.

In a typical boathouse, the studs 13 are 18 feet high, the distance between the inner surfaces of the studs 13 is 28 feet 8½ inches, the roof rafters 22 from peak 28 to outer end 12 is 18 feet, the truss struts 32 are 22 feet, the king post 35 is 3 feet 5 inches, the distance from the bolt 36 to the center of the runner 50 is 7 feet and the distance from the runner 50 to the inner edge of the beam 15 is 7 feet. Furthermore, the distance from the peak 28 to the queen pin 40 is approximately 5 feet 6 inches and the angle $\alpha$ suspended between the roof rafter 22 and the vertical center line 21 is approximately 68° while the distance which the roof rafter 22 protrudes outwardly of the sidewall 17 is approximately 2 feet. The runners 50 are 1×8 longitudinal members which stiffen and join all trusses together.

As stated above, the truss assembly and the roof 23 which it supports and have withstood winds in excess of 145 miles per hour. This was during the hurricane Frederick which recently struck Mobile, Ala.

It will be obvious to those skilled in the art that many variations may be made in the embodiment here chosen for the purpose of illustrating the present invention and that full result may be had to the doctrine of equivalents, without departing from the scope of the present invention as defined by the appended claims.

I claim:

1. A truss assembly comprising:

(a) a pair of upwardly and inwardly converging, generally straight, opposed roof rafters disposed in generally transverse alignment, the inner end portions of which are in abutting relationship to each other to define a peak for said rafters along a vertical centerline;

(b) a pair of truss struts disposed generally below said roof rafters, the outer end portions of said truss struts being respectively connected to the opposite sides of the outer end portion of said roof rafters, the inner end portion of each of said truss struts being connected to the side of the opposite roof rafter from the roof rafter to which its outer end portion is connected, said inner end portion being connected thereto intermediate the ends of such roof rafter, said truss struts having intermediate portions crossing and spaced from each other below said peak;

(c) a king pin connected to said intermediate portions of said truss struts and said roof rafters, the upper end portion of said king pin abutting and being fixed to the lower surfaces of the end portions of said roof rafters, the lower end portion of said king pin being disposed between said intermediate portions of said truss struts.

(d) a common bolt extending through one of said truss struts and thence through the lower end portion of said king posts and thence through the other of said intermediate portions of said truss struts;

(e) a pair of opposed, spaced, vertically arranged, queen posts disposed on opposite sides of said vertical centerline and having their upper ends respectively abutting the lower edges of said roof rafters at positions adjacent to the inner end portions of the other of said truss struts, said queen posts being fixed to the sides of said inner end portions of said truss struts and extending generally vertically downwardly, said queen posts being respectively joined at their lower end portions to side portions of said truss struts.

2. The truss assembly defined in claim 1 wherein the inner end portion of each of said truss struts is connected to said roof rafters at approximately a position which is a distance from said peak equal to approximately one-third of the length of said roof rafter.

3. The truss assembly defined in claim 1 wherein said roof rafters are notched along their lower outer end portions to provide bearing surfaces in a common horizontal transverse plane.

4. The truss assembly defined in claim 1 including a building structure for supporting said truss assembly, said building structure including a pair of upright sidewalls having an upper surface and wherein said roof rafters are provided with bearing surfaces in a common plane for resting on the said upper surfaces.

5. The truss assembly defined in claim 1 including additional truss assemblies identical to the aforesaid truss assembly and equally spaced longitudinally along the length of said sidewalls.

6. The truss assembly defined in claim 5 including parallel runners extending longitudinally between intermediate portions of the truss struts of said assemblies.

* * * * *